US005697576A

United States Patent [19]

Bloch et al.

[11] Patent Number: 5,697,576

[45] Date of Patent: Dec. 16, 1997

[54] SYSTEM AND METHOD OF DISPENSING CORELESS ROLLS OF PAPER PRODUCTS

[75] Inventors: Nathan D. Bloch, Cherry Hill; Joseph Mitchell, Deptford; Edward J. O'Brien, Eastampton, all of N.J.; Bruce M. Gemmell, Wilmington, Del.

[73] Assignee: Kimberly-Clark Worldwide, Inc., Neenah, Wis.

[21] Appl. No.: 395,327

[22] Filed: Feb. 28, 1995

[51] Int. Cl.[6] ..... B65H 16/06; B65H 18/04

[52] U.S. Cl. ..... 242/596.8; 242/596.3; 242/596.7

[58] Field of Search ..... 242/596.3, 596.7, 242/596.8, 597.8, 598.5; 312/34.8

[56] References Cited

U.S. PATENT DOCUMENTS

| | | | |
|---|---|---|---|
| 390,084 | 9/1888 | Lane | 242/596.3 |
| 419,811 | 1/1890 | Zerr | 242/423 |
| 1,217,211 | 2/1917 | Pico | 242/596.4 |
| 2,905,404 | 2/1959 | Simmons | 242/55.2 |
| 2,928,619 | 3/1960 | Burton et al. | 242/596.7 |
| 3,032,283 | 5/1962 | Wooster | 242/160.1 |
| 3,729,145 | 4/1973 | Koo et al. | 242/596.8 X |
| 4,013,236 | 3/1977 | Perrin | 242/160.1 |
| 4,113,195 | 9/1978 | Theunissen | 242/560.2 |
| 4,383,657 | 5/1983 | Suh | 242/596.3 X |
| 4,662,576 | 5/1987 | Paul | 242/596.4 |
| 5,065,924 | 11/1991 | Granger | 225/46 |
| 5,314,131 | 5/1994 | McCanless et al. | 242/55.3 |
| 5,370,339 | 12/1994 | Moody et al. | 242/597.6 |

*Primary Examiner*—John Q. Nguyen
*Attorney, Agent, or Firm*—Karl V. Sidor

[57] ABSTRACT

A system and method of installing a coreless roll of an absorbent consumer paper product in a dispenser performs or includes steps of orienting the coreless roll to a desired position of alignment within the dispenser, and securing the coreless roll to the dispenser by penetrating the coreless roll with at least one projection that penetrates between adjacent layers of paper product in the coreless roll so that the coreless roll is secured against radial displacement with respect to the dispenser during operation. A temporary holding mechanism may be provided to hold the coreless roll in an intended position of alignment while the coreless roll is being secured to the dispenser.

14 Claims, 5 Drawing Sheets

SYSTEM AND METHOD OF DISPENSING CORELESS ROLLS OF PAPER PRODUCTS

BACKGROUND OF THE INVENTION

1. Field of the Invention

This invention pertains to the field of commercial and consumer absorbent paper products, which includes toilet tissue and paper towels. More specifically, this invention relates to an improved dispenser and method of dispensing a coreless roll of absorbent paper product.

2. Description of the Related Technology

Commercial and consumer absorbent paper products such as toilet tissue and paper towels are typically distributed and dispensed in roll form, and nearly always include a hollow cylindrical core that the product is wrapped about. The core is usually some type of cardboard, which is glued together and to the product so that the core stays intact and the product does not separate from the core. The product is then dispensed by mounting the roll on a spindle, such as can be found on the ubiquitous bathroom toilet roll dispenser, that passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Recently, coreless rolls of toilet tissue have appeared on the market, primarily in Europe, that are wound throughout the entire diameter of the roll. There are advantages and disadvantages associated with the coreless rolls. Coreless rolls are ecologically superior to cored rolls because less adhesives are used to make the product. In addition, more product can be provided in the space that would otherwise have been occupied by the core. Cored rolls are more expensive to manufacture than coreless rolls because of the expense of making the cores and joining the cores to the product. In addition, coreless rolls have the advantage of being less subject to pilferage in commercial locations because of their inherent incompatibility with conventional dispensers.

On the other hand, there are dispensing problems with coreless rolls that have so far been difficult to overcome. Conventional dispensers for coreless rolls typically include an enclosed support surface that the roll is supported on as it turns, and an opening through which the product is passed. While functional, these dispensers have some undesirable characteristics, including an inability to control drag resistance to withdrawal of the product; the fact that the product actually touches the inside of the dispenser, which might be considered unsanitary by some consumers; and an inability to provide 180 degree product access to the consumer. It is clear that a need exists for an improved system and method for dispensing coreless rolls of absorbent consumer and commercial paper products.

SUMMARY OF THE INVENTION

Accordingly, it is an object of the invention to provide an improved system and method for dispensing coreless rolls of absorbent consumer and commercial paper products.

In order to achieve the above and other objects of the invention, an assembly for dispensing a coreless roll of an absorbent consumer paper product such as toilet tissue includes, according to a first aspect of the invention, a frame; a mounting mechanism for permitting the frame to be mounted to a stationary surface such as a wall; and a coreless roll securing mechanism for securing a coreless roll of toilet tissue for rotation within the frame, the coreless roll securing means comprising at least one projection that is constructed and arranged to penetrate into the coreless roll between adjacent layers of the coreless roll so as to prevent radial displacement of the coreless roll with respect to the frame during use, whereby an ecologically responsible coreless roll of absorbent paper product can be dispensed without fear of radial displacement as confidently as a conventional cored roll of product can be.

According to a second aspect of the invention, a method of installing a coreless roll of an absorbent consumer paper product in a dispenser, includes steps of (a)

orienting the coreless roll to a desired position of alignment within the dispenser; and (b) securing the coreless roll to the dispenser by penetrating the coreless roll with at least one projection that penetrates between adjacent layers of paper product in the coreless roll, whereby the coreless roll is secured against radial displacement with respect to the dispenser during operation.

According to third aspect of the invention, a method of installing a coreless roll of an absorbent consumer paper product in a dispenser includes steps of (a) placing the coreless roll in the dispenser on a temporary holding mechanism that will orient the coreless roll to a desired position of alignment within the dispenser; (b) securing the coreless roll to the dispenser so that the coreless roll will be mounted to rotate with respect to the dispenser; and (c) withdrawing the temporary holding mechanism away from the coreless roll, whereby the coreless roll will be permitted to rotate without being impeded by the temporary holding mechanism.

Finally, according to a fourth aspect of the invention, an assembly for dispensing a coreless roll of an absorbent consumer paper product includes a temporary holding mechanism for orienting the coreless roll to a desired position of alignment within the dispenser; a securing mechanism for securing the coreless roll to the dispenser so that the coreless roll will be mounted to rotate with respect to the dispenser; and a release mechanism for withdrawing the temporary holding mechanism away from the coreless roll after the coreless roll has been secured by the securing mechanism, whereby the coreless roll will be permitted to rotate without being impeded by the temporary holding mechanism.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
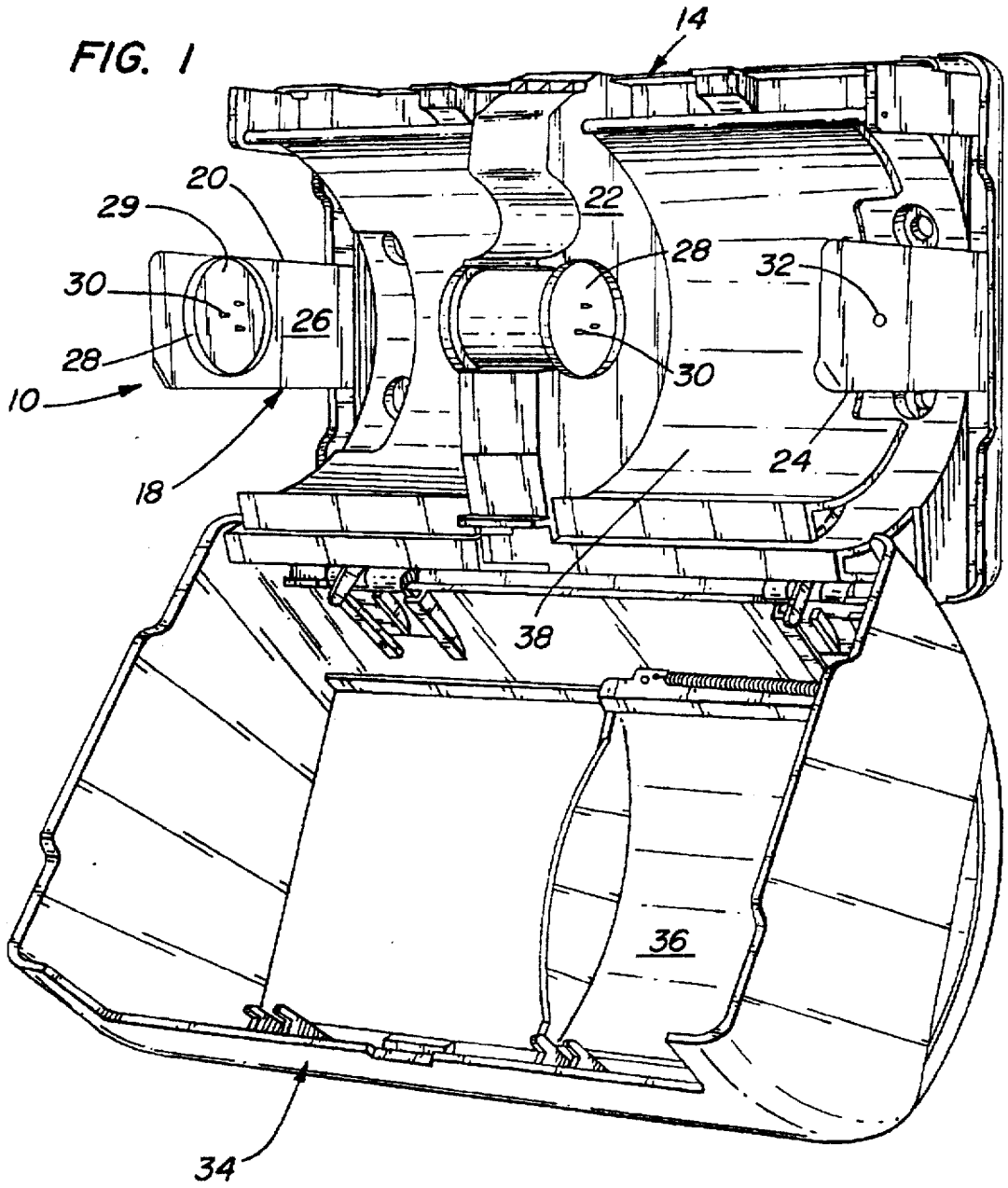
FIG. 1 is a perspective view of an assembly for dispensing a coreless roll of an absorbent consumer paper product that is constructed according to a first preferred embodiment of the invention, shown in an open position.

Referring now to the drawings, wherein like reference numerals designate corresponding structure throughout the views, and referring in particular to FIGS. 1–4, an assembly 10 for dispensing a coreless roll 12 of an absorbent consumer paper product such as toilet tissue includes a frame 14 that has a mounting hole 16 defined therein for permitting the frame to be mounted to a stationary surface, such as a wall. Assembly 10 further includes a coreless roll securing mechanism 18 for securing a coreless roll 12 of toilet tissue for rotation within the frame 14. In the embodiment shown in FIGS. 1–4, coreless roll securing mechanism 18 includes a first arm 20, a second, central arm 22 and a third arm 24 as may best be seen in FIG. 1. The assembly 10 depicted in FIGS. 1–4 is designed to accommodate two rolls of coreless toilet tissue, much in the manner of many conventional dispensers that are available for commercial application. The outer arms 20, 24 are constructed out of a resilient material, such as spring steel, and are configured so they will be slightly displaced when a coreless roll is secured between the central arm 22 and the respective outer arms 20, 24. In this way, the outer arms 20, 24 will bias the respective coreless roll 12 toward the central arm 22, in a manner that will be described in greater detail below.

One important advantage of the invention is that the coreless roll securing mechanism 18 is designed to prevent radial displacement of the coreless rolls 12 with respect to the frame 14 of the assembly 10 during use, so that a coreless roll can be dispensed without fear of radial displacement during use as confidently as a conventional cored roll of absorbent paper product can be. In the preferred embodiment, this is achieved by providing pressure plates 28 on inner surfaces 26 of the respective arms 20, 22, 24 of the securing mechanism 18. Advantageously, a number of projections 30, preferably but not necessarily more than one, extend inwardly from the respective pressure plates 28 toward where the coreless roll 12 of tissue will be held during operation. Projections 30 are specifically designed to penetrate the coreless roll between adjacent layers of the coreless roll to prevent radial displacement of the coreless roll during use. It will be appreciated that the biasing provided by the resiliency of arms 20, 24 will aid the projections 30 in penetrating between adjacent layers of the coreless roll and enhance the securement of the coreless rolls within the assembly 10 during use.

Pressure plates 28 are preferably mounted to rotate with respect to respective arms 20, 22, 24. This can be accomplished by means of a bearing pin 32, as is shown in FIG. 1. Other well known mechanical arrangements could be provided to achieve this effect as well.

Figure 2:
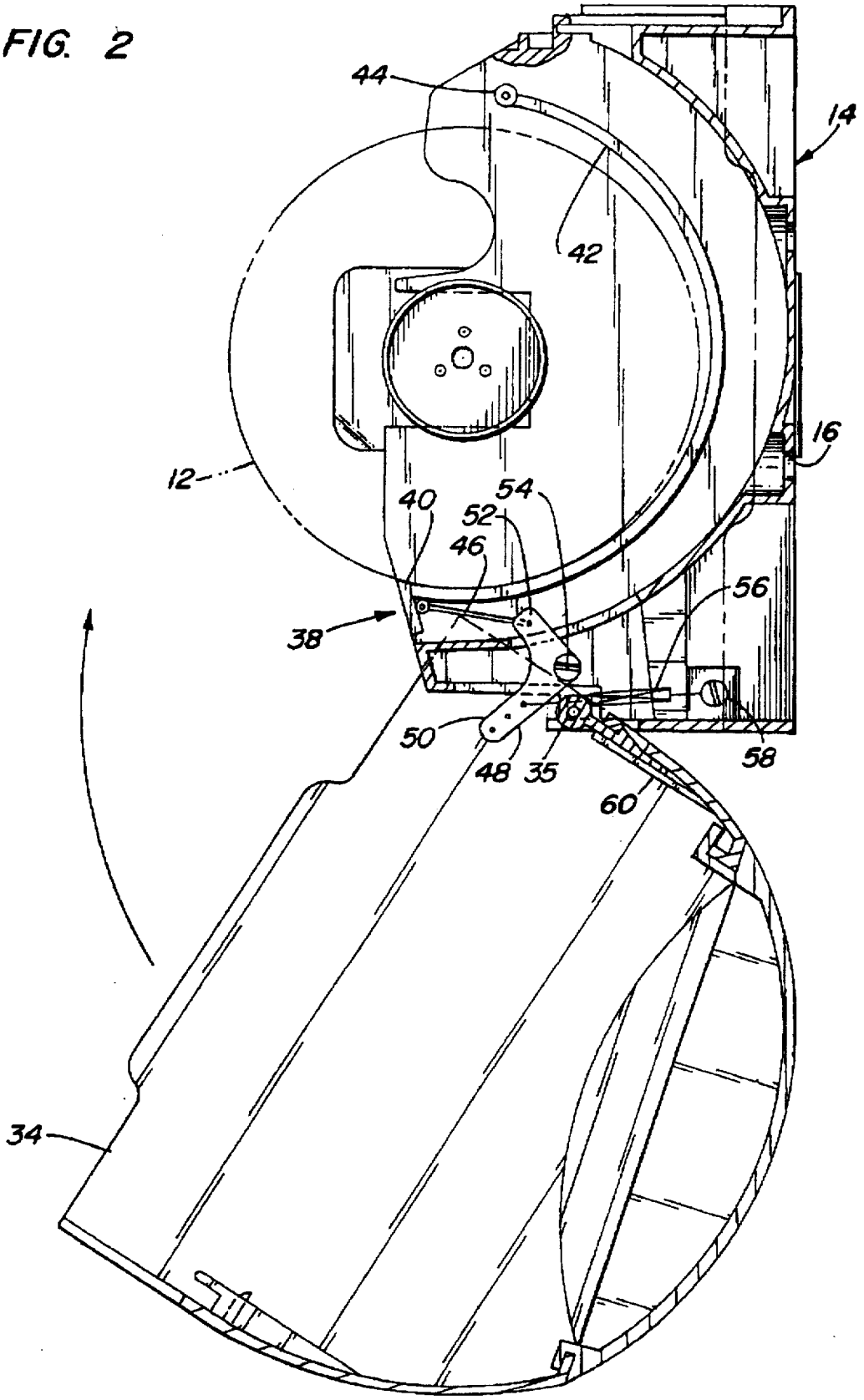
FIG. 2 is a cross sectional view depicting the assembly shown in FIG. 1 in an open position.
Figure 3:
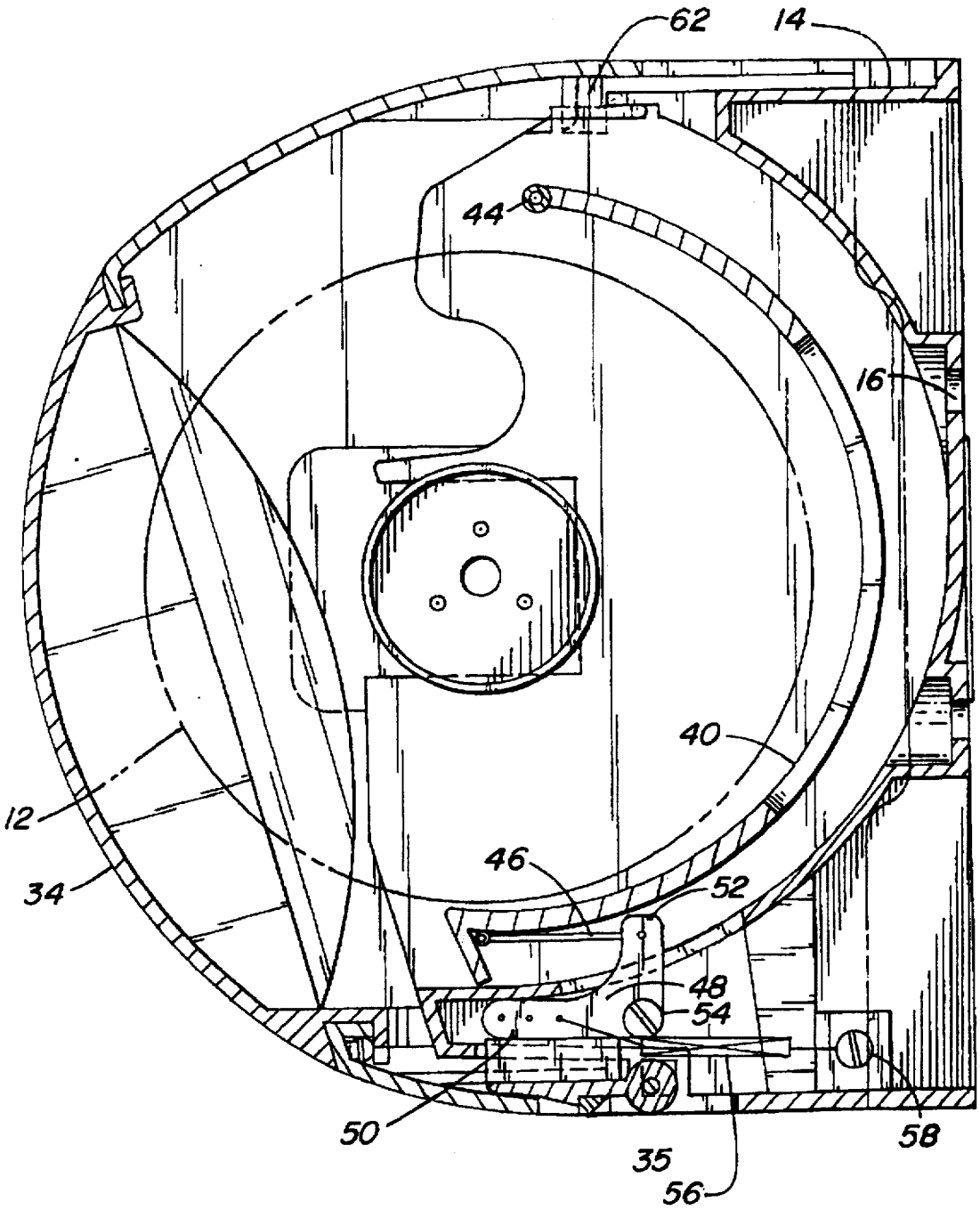
FIG. 3 is a cross sectional view of the assembly depicted in FIGS. 1 and 2, shown in a closed position.
Figure 4:
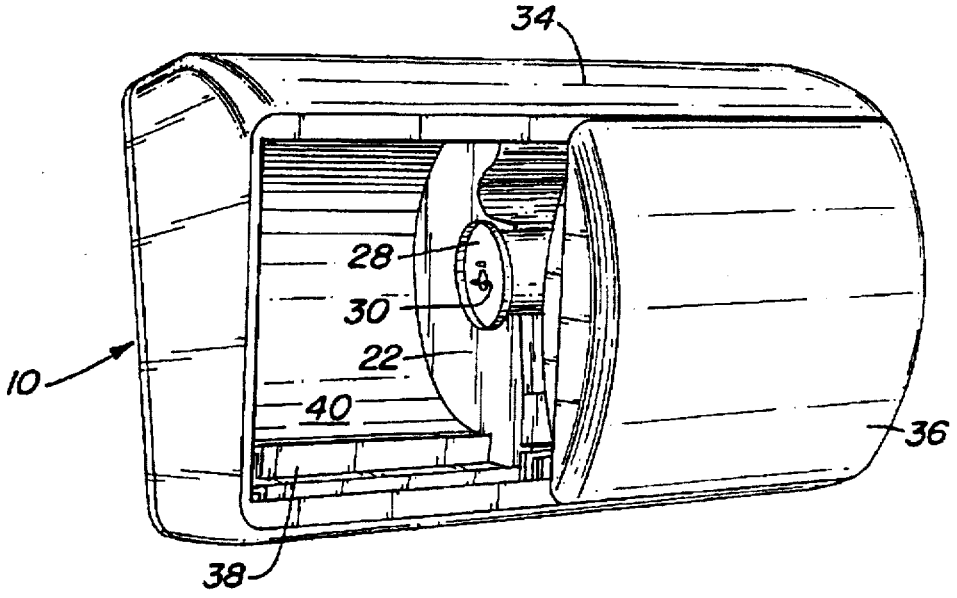
FIG. 4 is a perspective view of the assembly depicted in FIGS. 1–3, shown in a closed position.

Preferably, assembly 10 includes a cover 34 that is hinged to frame 14 by a hinge 35, best seen in FIGS. 2 and 3. A sliding window 36 is provided in the cover 34 to selectively expose the roll 12 of coreless tissue that is being dispensed at a particular point in time, and to deny access to the other roll or vacated mounting location. Cover 34 and sliding window 36 are conventional.

One important aspect of the invention is that, in the embodiment of FIGS. 1–4, assembly 10 is provided with a temporary holding mechanism 38 for holding a coreless roll 12 in a position of alignment with respect to the securing mechanism 18, and specifically with respect to pressure plate 28, when the coreless roll 12 is being installed into the assembly 10. As may best be seen in FIGS. 2 and 3, temporary holding mechanism 38 preferably includes a platform 40 for supporting the coreless roll 12 that has an inner surface 42 that is curved to approximate the outer circumference of the roll 12. The roll 12 will be cradled relatively immovably in the inner surface 42 of platform 40 during installation of the roll 12 into the assembly 10. The platform 40 is configured to pivot with respect to frame 14 about a pivot point 44, best seen in FIGS. 2 and 3. A push rod 46 connects a lower portion of the platform 40 with a second portion 52 of a rocker arm 48, as shown in FIGS. 2 and 3. Rocker arm 48 is mounted to pivot with respect to frame 14 at a pivot point 54, and further includes a first portion 50 that is designed to contact a contact surface 60 on an inside surface of cover 34 when cover 34 is being closed, as may be seen in FIGS. 2 and 3. The first portion 50 of rocker arm 48 is biased with respect to frame 14 by means of a tension spring 56 that is mounted between first portion 50 and affixation point 58 on frame 14. This biasing urges rocker arm 48 to pivot in a counter clockwise direction about pivot point 54, and thus tends to urge platform 40 to the position shown in FIG. 2, where it will contact the outer circumference of coreless roll 12 in a position of alignment with respect to the pressure plates 28 of the coreless roll securing mechanism 18. However, when cover 34 is closed, as may be seen by comparing FIG. 3 to FIG. 2, the first portion 50 of rocker arm 48 will be urged in a clockwise direction about pivot point 54 by contact of first portion 50 with the contact surface 60 on cover 34. The entire rocker arm 48 will thus move in a clockwise direction, causing second portion 52 of rocker arm 48 and push rod 46 to rotate the platform 40 in a counter clockwise direction with respect to pivot point 44. This will tend to withdraw the platform 40 from its position contacting the coreless roll 12. Thus, when cover 34 is closed, the coreless roll 12 will be free to rotate without interference from the platform 40. The mechanism 62 that is used for latching the cover 34 in the closed position is shown in FIG. 3.

Figure 5:
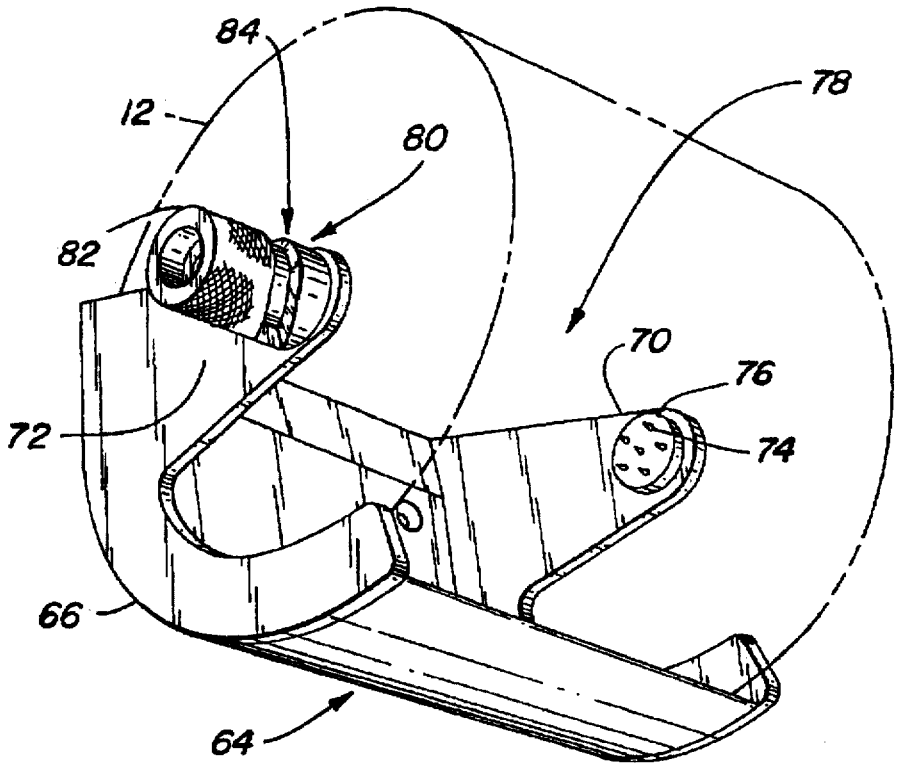
FIG. 5 is a perspective view of an assembly for dispensing a coreless roll of an absorbent consumer paper product that is constructed according to a second preferred embodiment of the invention.
Figure 6:
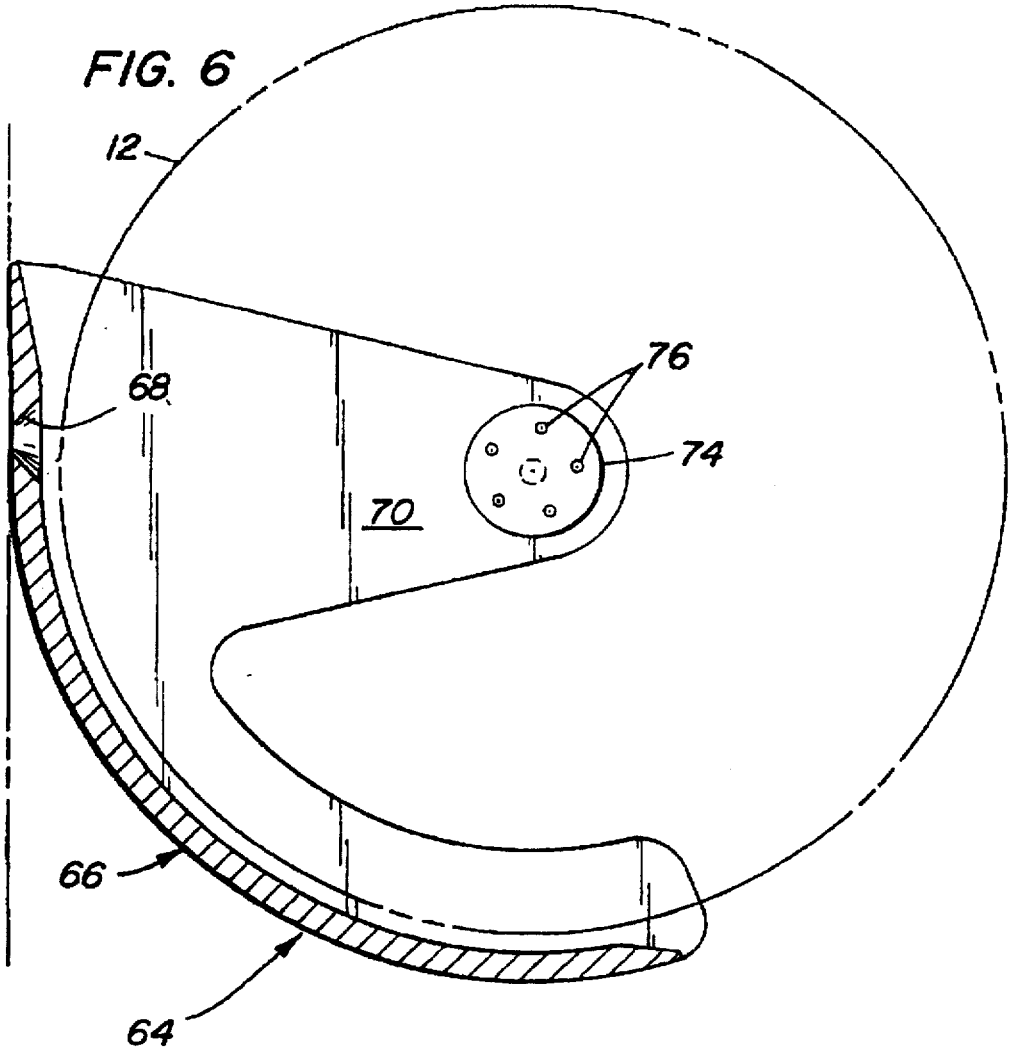
FIG. 6 is a cross sectional view of a portion of the assembly shown in FIG. 5.
Figure 7:
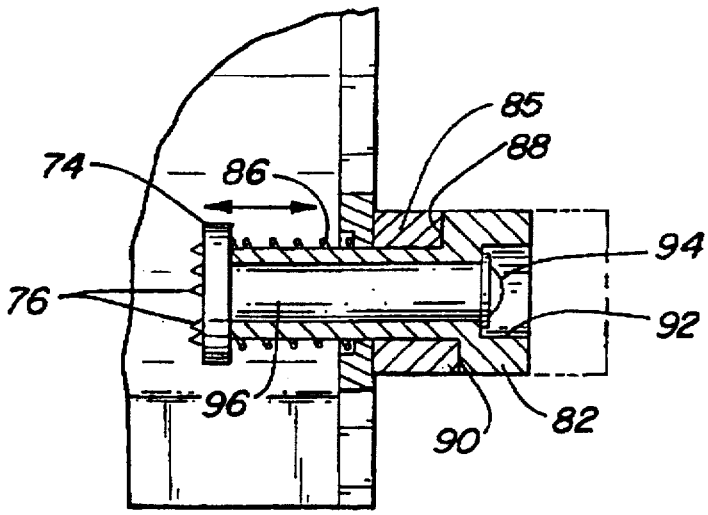
FIG. 7 is a fragmentary cross sectional view through a portion of the assembly shown in FIGS. 5 and 6.

Referring now to FIGS. 5–7, an assembly 64 for dispensing a coreless roll 12 of an absorbent consumer paper product such as toilet tissue includes, according to a second embodiment of the invention, a frame 66, which is embodied as a relatively simplified shield about the space where coreless roll 12 will be positioned during use. Frame 66 has a mounting hole 68 defined in a rear portion thereof for mounting the assembly 64 to a stationary surface, such as a wall. The assembly 64 further includes a coreless roll securing mechanism 78 that is embodied as a first arm 70 and a second arm 72, as may best be seen in FIG. 5. A pair of pressure plates 76 are rotatively mounted to the respective arms 70, 72 and have projections 74 thereon that are constructed and arranged to penetrate into the coreless roll 12 between the adjacent layers of the coreless roll 12 in the manner described above with respect to the first described embodiment.

One advantageous feature in the embodiment of the invention that is depicted in FIGS. 5–7 is the provision of a retracting mechanism 80 for retracting one of the pressure plates 76 so that the pressure plates 76 can be moved apart during loading and unloading of the coreless roll 12 onto and out of the assembly 64. As may best be seen in FIG. 7, one of the pressure plates 74 is preferably spring biased by means of compression spring 86 toward the oppositely facing pressure plate 76. A camming mechanism 84 is provided to retract the pressure plate 74 against the bias of spring 86. In the illustrated embodiment, camming mechanism 84 includes a knob 82 having a first cam surface 88, and a sleeve 85 having a second, opposed cam surface 90. When knob 82 is turned, as is shown diagrammatically in FIG. 7, the interaction of cam surfaces 88, 90 will urge pressure plate 74 away from oppositely facing pressure plate against the bias of spring 86. Pressure plate 74 is rotatively mounted with respect to knob 82 by a pin 96 that is secured to pressure plate 74 and is free to rotate within the knob member 82. Pin 96 has a head 94 that is provided within a detent 92 in the knob 82, as is shown in FIG. 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of installing a coreless roll of an absorbent consumer paper product in a dispenser, comprising steps of:

(a) orienting the coreless roll to a desired position of alignment within the dispenser at which the coreless roll will operatively rotate by placing the coreless roll in a temporary holding mechanism;

(b) securing the coreless roll to the dispenser by penetrating each respective axial end face of the coreless roll with at least one projection that penetrates between adjacent layers of paper product in the coreless roll, whereby the coreless is secured against radial displacement with respect to the dispenser during operation; and (c) withdrawing the temporary holding mechanism after step (b).

2. A method according to claim 1, wherein step (a) comprises holding the coreless roll in the desired position by hand.

3. A method according to claim 1, wherein step (b) comprises penetrating at least one of said respective end faces of the coreless roll with a plurality of projections.

4. A method according to claim 1, wherein step (b) comprises penetrating both of said respective end faces of the coreless roll with a plurality of projections.

5. A method according to claim 1, further comprising the step 1, further comprising the step of resiliently biasing the projection into the coreless roll during operation.

6. A method of installing a coreless roll of an absorbent consumer paper product in a dispenser, comprising steps of:

(a) placing the coreless roll in the dispenser on a temporary holding mechanism that will orient the coreless roll to a desired position of alignment within the dispenser at which the coreless roll will operatively rotate wherein the dispenser has an outer cover operatively connected to the temporary holding mechanism such that the temporary holding mechanism contacts the outer circumference of the coreless roll in a position of alignment when the outer cover is opened;

(b) rotably securing the coreless roll to the dispenser so that the coreless roll will be mounted in the desired position of alignment to rotate with respect to the dispenser; and (c) withdrawing the temporary holding mechanism away from the coreless roll by closing the outer cover after the coreless roll has been secured in the dispenser, whereby the coreless roll will be permitted to rotate without being impeded by the temporary holding mechanism.

7. An assembly for dispensing a coreless roll of an absorbent consumer paper product, comprising:

an outer cover, temporary holding means for orienting the coreless roll to a desired position of alignment within the dispenser at which the coreless roll will operatively rotate;

rotably securing means for securing the coreless roll to the dispenser so that the coreless roll will be mounted in the desired position of alignment to rotate with respect to the dispenser; and release means for withdrawing the temporary holding means away from the coreless roll after the coreless roll has been secured by said securing means and wherein said release means is interlocked with said outer cover so that it will withdraw said temporary holding means away from the coreless roll when said outer cover is closed, whereby the coreless roll will be permitted to rotate without being impeded by the temporary holding means.

8. An assembly according to claim 7, wherein said temporary holding means comprises a platform for supporting the coreless roll.

9. An assembly according to claim 8, wherein said platform is curved to approximate the outer circumference of the roll, whereby the roll is cradled relatively immovably in said platform.

10. An assembly according to claim 7, wherein said securing means further comprises a pair of opposed arms, and at least one projection is mounted to a side of each of said arms to engage an axial end face of the coreless roll, said projection, being constructed and arranged to penetrate into the coreless roll between adjacent layers of the coreless roll so as to prevent radial displacement of the coreless roll with respect to said frame during use.

11. An assembly according to claim 10, further comprising biasing means for resiliently biasing at least one of said projections toward said coreless roll.

12. An assembly according to claim 11, wherein said biasing means comprises at least one of said opposed arms being constructed out of a resilient material, and said at least one arm is configured to be movable against a force of said biasing means from an at-rest position, said at least one arm being moved from said at-rest position when a coreless roll is secured within said assembly.

13. An assembly according to claim 7, wherein said securing means comprises a pressure plate that is mounted for rotation at a location operatively proximate an axial end face of said coreless roll, and wherein said pressure plate includes at least one projection extending from a surface of said pressure plate adjacent to said end face.

14. An assembly according to claim 13, wherein said pressure plate has a plurality of said projections provided thereon.

* * * * *